US008984702B2

(12) United States Patent
Pant

(10) Patent No.: US 8,984,702 B2
(45) Date of Patent: Mar. 24, 2015

(54) MULTIPURPOSE CLEANING APPARATUS

(76) Inventor: Shashank Pant, Ottawa (CA)

( * ) Notice: Subject to any disclaimer, the term of this patent is extended or adjusted under 35 U.S.C. 154(b) by 381 days.

(21) Appl. No.: 13/556,962

(22) Filed: Jul. 24, 2012

(65) Prior Publication Data

US 2014/0026342 A1 Jan. 30, 2014

(51) Int. Cl.

| | |
|---|---|
| ***A46B 17/02*** | (2006.01) |
| ***A47L 13/24*** | (2006.01) |
| ***A46B 5/00*** | (2006.01) |
| ***A46B 7/04*** | (2006.01) |
| ***A46B 11/00*** | (2006.01) |
| ***A47L 13/12*** | (2006.01) |
| ***A47L 13/22*** | (2006.01) |
| ***A47L 13/256*** | (2006.01) |
| ***A47L 13/258*** | (2006.01) |
| *A46B 7/02* | (2006.01) |
| *A46B 17/04* | (2006.01) |

(52) U.S. Cl.

CPC ..... *A46B 17/02* (2013.01); *A47L 13/24* (2013.01); *A46B 5/0058* (2013.01); *A46B 7/023* (2013.01); *A46B 7/042* (2013.01); *A46B 11/0055* (2013.01); *A46B 17/04* (2013.01); *A46B 2200/302* (2013.01); *A47L 13/12* (2013.01); *A47L 13/22* (2013.01); *A47L 13/256* (2013.01); *A47L 13/258* (2013.01)

USPC ..... 15/146; 15/105

(58) Field of Classification Search

CPC ..... A46B 17/02; A46B 2200/302; A46B 15/0055; A46B 7/023; A47L 13/12

USPC ..... 15/146, 148, 150, 105, 111, 114, 178, 15/228, 231

See application file for complete search history.

(56) References Cited

U.S. PATENT DOCUMENTS

| | | | | |
|---|---|---|---|---|
| 702,875 | A | 6/1902 | Hunt | |
| 1,778,325 | A | 10/1930 | Koizumi | |
| 2,446,814 | A | 8/1948 | Crofton | |
| 3,600,740 | A | 8/1971 | Ogier | |
| 4,491,998 | A | 1/1985 | Wilson et al. | |
| 4,654,920 | A | 4/1987 | O'Neil, Jr. et al. | |
| 4,852,210 | A | 8/1989 | Krajicek | |
| 5,848,451 | A | 12/1998 | Barnett | |
| 5,896,613 | A | 4/1999 | Courtney et al. | |
| 5,937,471 | A * | 8/1999 | Liao | 15/111 |
| 6,659,670 | B1 | 12/2003 | Blouse | |
| 7,163,349 | B2 | 1/2007 | Policicchio et al. | |
| 7,225,495 | B2 | 6/2007 | Berti et al. | |
| 7,260,864 | B1 | 8/2007 | Morad | |
| 7,398,576 | B2 * | 7/2008 | Horian | 15/116.2 |
| 7,584,518 | B1 | 9/2009 | Morad | |
| D625,481 | S | 10/2010 | Raven | |
| 2003/0019065 | A1 | 1/2003 | Smith et al. | |
| 2006/0277704 | A1 * | 12/2006 | Pineschi | 15/105 |
| 2007/0136963 | A1 | 6/2007 | Vosbikian et al. | |
| 2008/0072388 | A1 | 3/2008 | Jones | |
| 2011/0158740 | A1 | 6/2011 | Kandasamy et al. | |

* cited by examiner

*Primary Examiner* — Shay Karls

(74) *Attorney, Agent, or Firm* — Stetina Brunda Garred & Brucker

(57) ABSTRACT

A multiple purpose cleaning apparatus may provide mopping or scrubbing functionality as well as sweeping functionality in a single apparatus. The cleaning apparatus comprises an extendable and retractable broom casing that extends from between a pair of pivotally connected panels. When the broom casing is extended from between the panels, the cleaning apparatus may be used as a broom. When the broom casing is retracted within the panels, the cleaning apparatus may be used as a mop or scrubber.

22 Claims, 13 Drawing Sheets

MULTIPURPOSE CLEANING APPARATUS

TECHNICAL FIELD

The current description relates to cleaning implements and in particular to cleaning implements having combined cleaning tools for mopping and sweeping.

BACKGROUND

Cleaning a surface such as a floor typically includes picking up dry loose contamination such as debris, dust and dirt, using a broom or a dry mop followed by mopping with a wet mop to dissolve and absorb dried-in liquid contaminations. Typically, separate implements, namely a broom and a mop, are required. Previous attempts at combining multiple functions, such as sweeping and mopping, into a single implement have been undesirable as some have required different heads or attachments to be removed or added to a handle. Other attempts have been cumbersome or limiting in that they do not allow both functions, that is the broom and the mop, to be used in a desired or preferred manner. In these attempts a broom is often attached on an opposite side of a mop to allow rotation of the implement to switch between sweeping and mopping; however, this does not easily accommodate the different cleaning strokes used for mopping, which is generally a pushing/pulling motion, and for sweeping, which uses a pivoting motion about a point on the handle.

An implement that provides the combined functionality of a mop and a broom that overcomes or mitigates a shortcoming of previous implements is desirable.

BRIEF DESCRIPTION OF THE FIGURES

Illustrative embodiments are described further herein with reference to the drawings, in which.

DETAILED DESCRIPTION

Figure 1B:
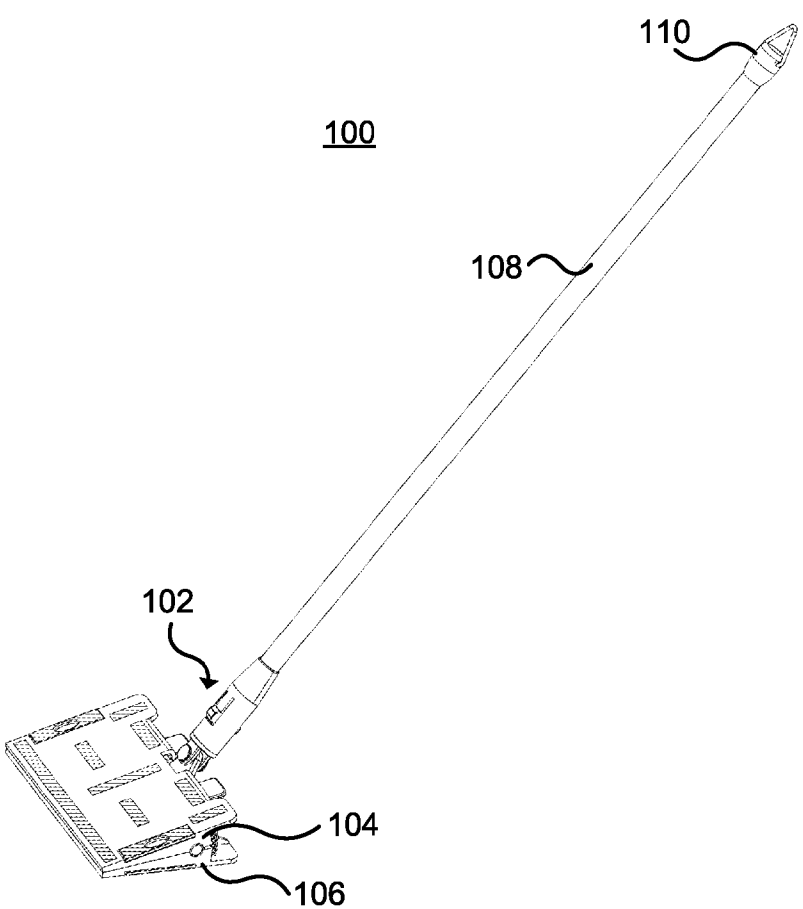
FIG. 1B is a perspective view of the multipurpose cleaning apparatus of FIG. 1A in a second position.

In accordance with the present disclosure there is provided a cleaning apparatus comprising: a cleaning head, a broom head and a handle rod. The cleaning head comprises a first panel having a first cleaning surface, a first interior side opposite the first cleaning surface and a first bottom edge; a second panel having a second cleaning surface, a second interior side opposite the second cleaning surface and a second bottom edge, the first and second panels pivotally connected to each other so that the first and second interior sides face each other with the first and second bottom edges adjacent to each other; and a broom casing received between the first and second panels, the broom casing slidable between a first position in which the broom casing is proximate to the first and second bottom edges and a second position in which the broom casing is retracted from the first and second bottom edges. The broom head is attached to the broom casing of the cleaning head. A substantial portion of the broom head extends past the first and second bottom edges to allow sweeping of a surface when the broom casing is in the first position and the broom head is substantially retracted between the first and second panels to allow cleaning of the surface using the first cleaning surface or the second cleaning surface when the broom casing is in the second position. The handle rod is rotatably coupled to the cleaning head.

In accordance with the present disclosure there is further provided a head of a cleaning apparatus comprising a first panel having a first cleaning surface, a first interior side opposite the first cleaning surface and a first bottom edge; a second panel having a second cleaning surface, a second interior side opposite the second cleaning surface and a second bottom edge, the first and second panels pivotally connected to each other so that the first and second interior sides face each other with the first and second bottom edges adjacent to each other; and a broom casing received between the first and second panels, the broom casing slidable between a first position in which the broom casing is proximate to the first and second bottom edges and a second position in which the broom casing is retracted from the first and second bottom edges.

Cleaning surfaces, such as floors, may require the use of one or more cleaning apparatuses, such as a broom, a dry mop, a wet mop and/or a scrubber. Although each cleaning apparatus may be used individually, cleaning a surface may require the subsequent use of a plurality of cleaning apparatuses. For example cleaning a surface may require first using a broom or dry mop to sweep the surface to remove loose debris and dirt, followed by wet mopping and scrubbing to remove dirt, stains and grime that is stuck or otherwise adhered to the surface after mopping or dry mopping. A cleaning apparatus that combines a broom with a mop and/or a scrubber in a single implement is described further herein. As described in further detail, the cleaning apparatus comprises of two panels that are pivotally connected together. Exterior surfaces of the two panels can be used as cleaning surfaces, allowing appropriate cleaning materials to be affixed to the cleaning apparatus to provide mopping and/or scrubbing functionality. A broom head is received in-between the pivotally connected panels and can be moved between; an extended position in which the broom head, or at least a significant portion of bristles of the broom head, extends substantially out from in-between the two panels, allowing the cleaning apparatus to be used as a broom; and a retracted position in which the broom head, or at least a substantial portion of bristles of the broom head, is substantially retracted in-between the two panels, allowing the cleaning surfaces of the cleaning apparatus to be used as a mop and/or scrubber. The cleaning apparatus may further incorporate a locking mechanism that releasably locks the broom in either the extended position or the retracted position to prevent or impede unintended movement of the boom head between the retracted position and the extended position.

The cleaning apparatus described herein allows one or two cleaning surfaces to be used as a mopping type implement, which may include scrubbing functionality. The cleaning surfaces can be covered with a cleaning material suitable for mopping a surface or scrubbing a surface. It is contemplated that the same or different cleaning materials can be mounted on the different cleaning surfaces. The cleaning material may be, for example, an absorbent surface for wet mopping, or may be material suitable for dry mopping such as an electrostatic material, or may be a non-scratch abrasive material for scrubbing. Additionally, or alternatively, one or more of the surfaces may provide a scrubbing surface useful for scrubbing. It is contemplated that further materials could be affixed to one or more of the cleaning surfaces, such as a cotton cloth or a dusting material. As will be appreciated, use of the cleaning apparatus as a mop or scrubber typically involves moving the cleaning surface over the surface being cleaned using a push/pull motion. When the broom is extended, the handle, which is rotatably coupled to the cleaning head to allow the cleaning surfaces to be used with a push/pull motion, may be locked or otherwise restricted from movement to allow the broom to be used with a typical sweeping motion, which may comprise pivoting the broom head about a point on the handle.

Figure 1A:
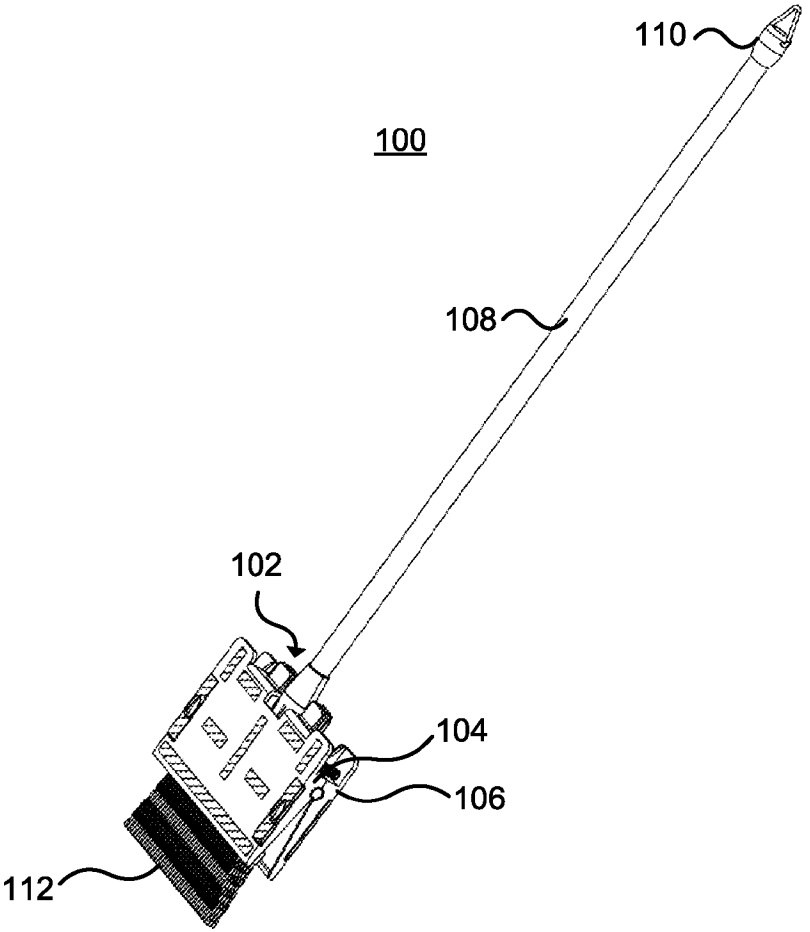
FIG. 1A is a perspective view of an embodiment of a multipurpose cleaning apparatus in a first position.
Figure 2:
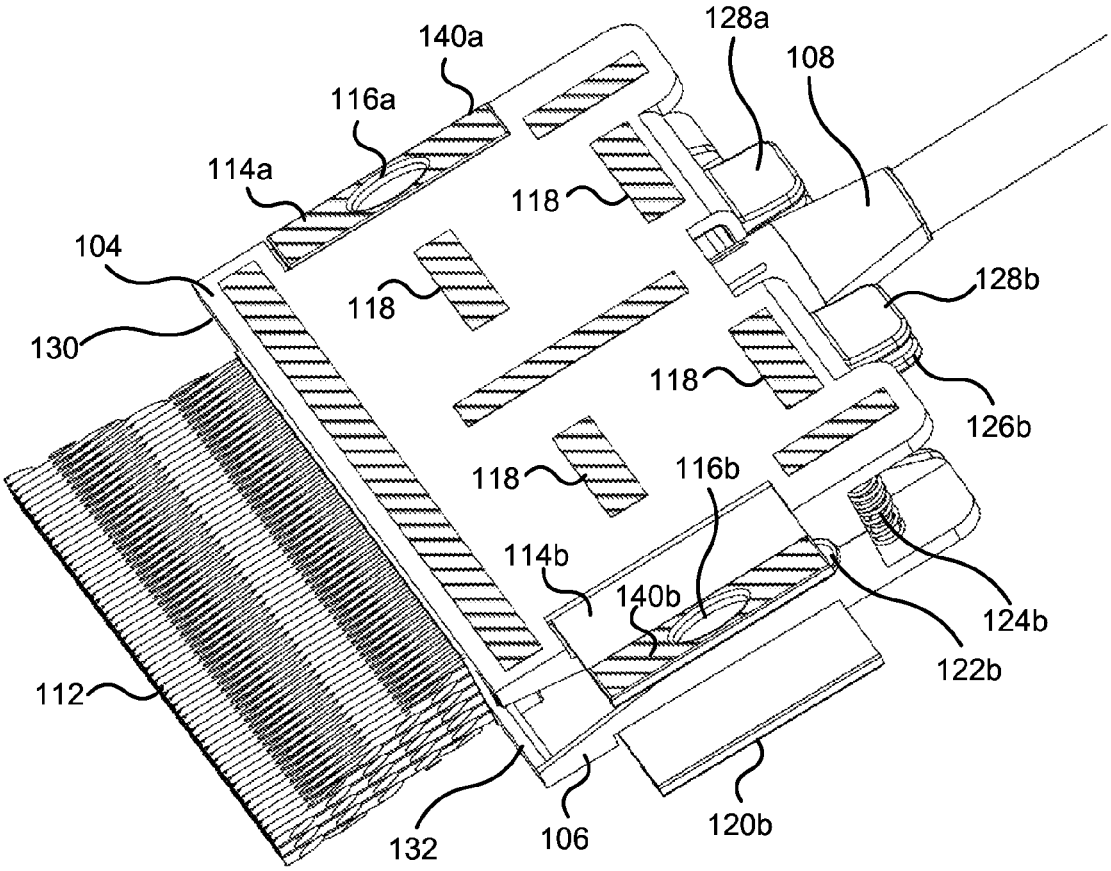
FIG. 2 is a perspective view of a cleaning head of the cleaning apparatus in the first position.
Figure 3:
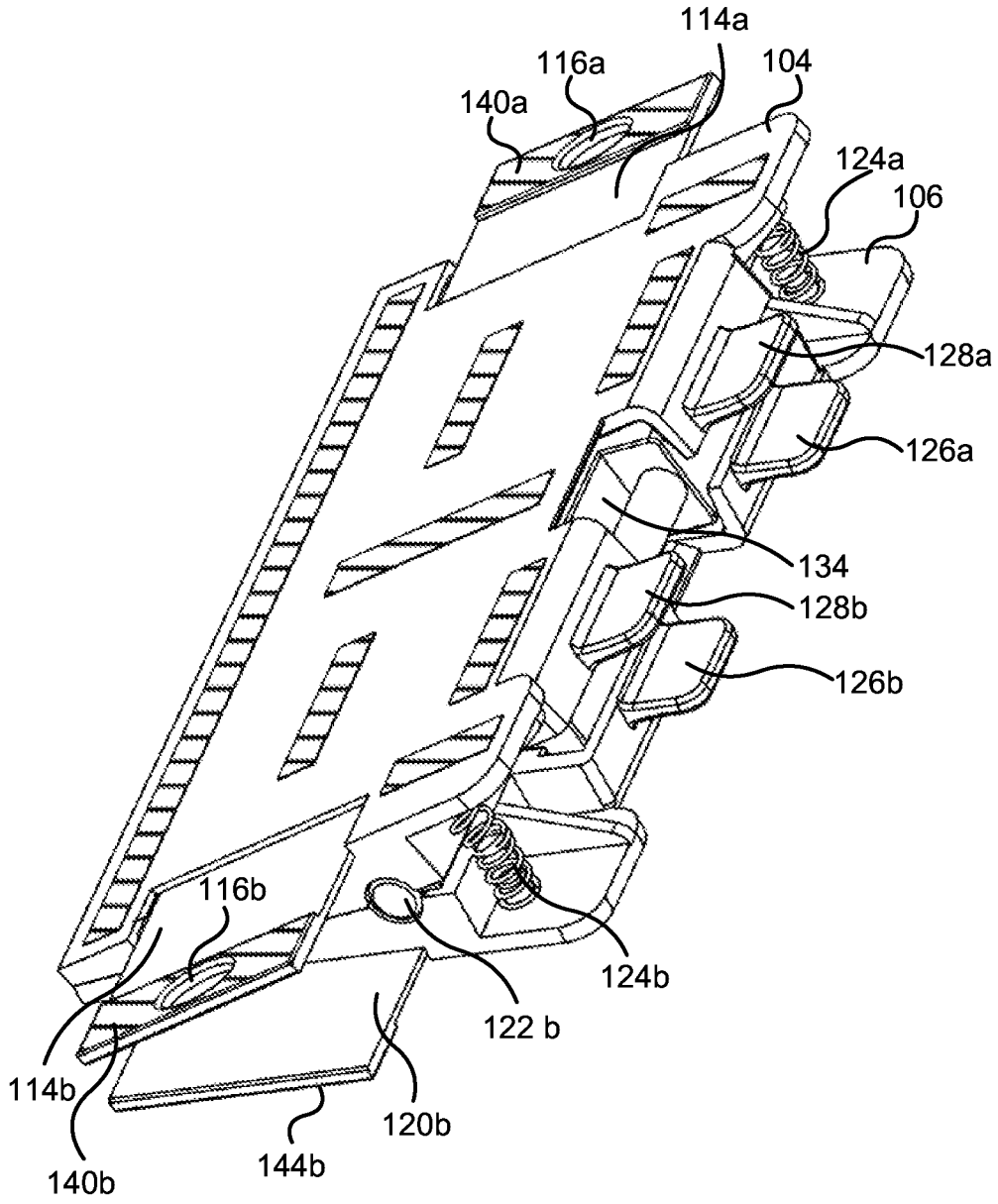
FIG. 3 is a perspective view of a cleaning head of the cleaning apparatus in the second position.
Figure 4:
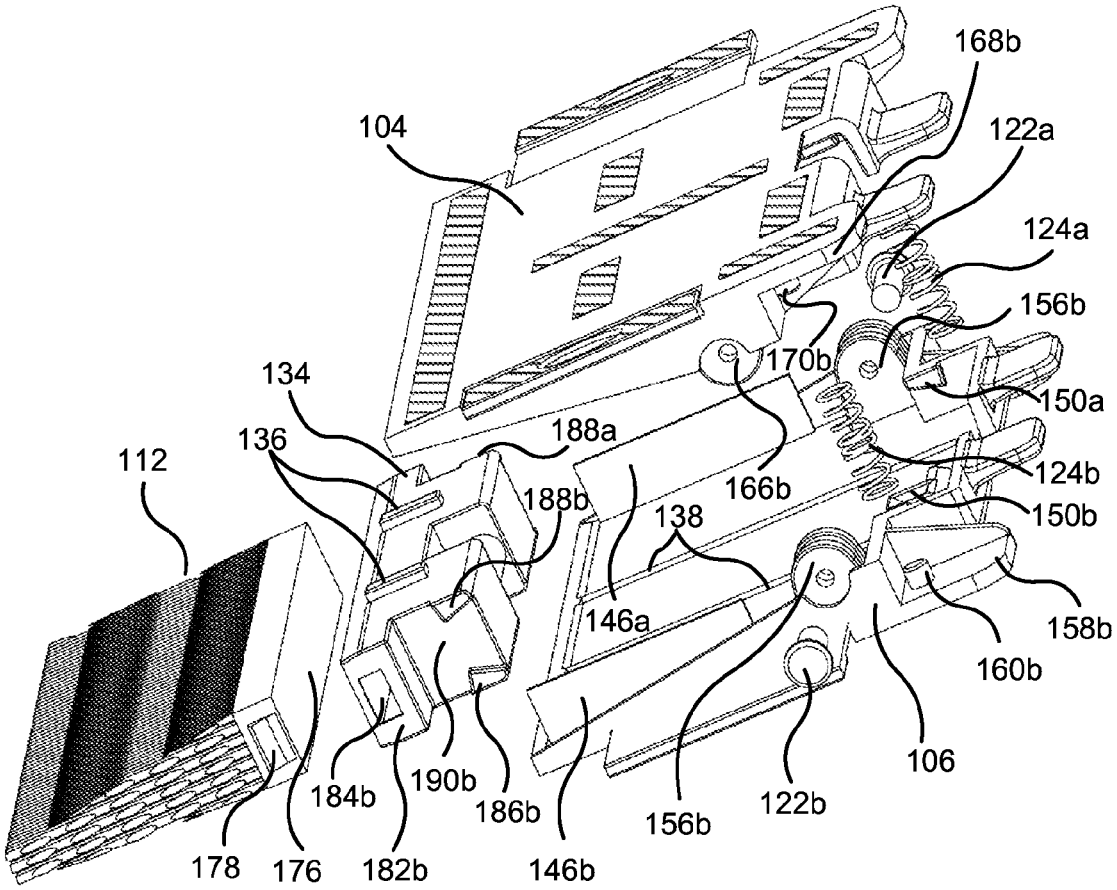
FIG. 4 is an exploded perspective view of the cleaning head of the cleaning apparatus.

FIG. 1A is a perspective view of an embodiment of a multipurpose cleaning apparatus in a first position. FIG. 1B is a perspective view of the multipurpose cleaning apparatus in a second position. The cleaning apparatus 100 is depicted in FIG. 1A with a broom head 112 in a first extended position, in which a broom head 112 is extended from the cleaning head, allowing the cleaning apparatus to be used as a broom. The broom head 112 can be retracted into the cleaning head 102 as depicted in FIG. 1B to allow the cleaning apparatus to be used for mopping and/or scrubbing.

The cleaning apparatus 100 includes a cleaning head 102 that is coupled to a handle 108. The handle 108 is used to grip and guide the cleaning apparatus 100 in the desired directions, either in a typical push/pull stroke for mopping and scrubbing or in a pivoting motion about the handle for sweeping. The handle 108 can be telescopic for adjusting the height and may include a hook no for easy storage. The cleaning head 102 provides the combined functionality of a mop and/or a scrubber as well as a broom. The cleaning head 102 comprises two panels 104, 106 that allow a broom head 112 to be retracted between the two panels 104, 106 to facilitate mopping and/or scrubbing using appropriate cleaning material affixed to respective cleaning surfaces of the two panels 104, 106. The broom head 112 may also be extended from between the two panels 104, 106 to facilitate sweeping.

The broom head 112 can be slid, or otherwise moved, to a retracted position in which substantially all of the broom head 112, and broom bristles 174, are retracted between the two panels 104, 106 allowing the cleaning head 102 to be used as a mop or scrubber as depicted in FIG. 1B. The broom head 112 can also be slid, or otherwise moved, to an extended position in which a portion of the broom head 112, or more particularly a substantial portion of the bristles attached to the broom head 112, are extended past the panels 104, 106 allowing the cleaning head 102 to be used as a broom as depicted in FIG. 1A.

Figure 5A:
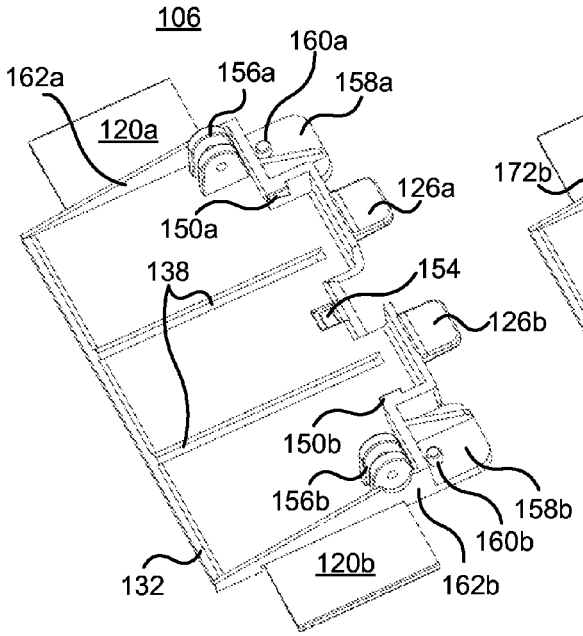
FIG. 5A is a perspective view of a first panel of the cleaning head.
Figure 5B:
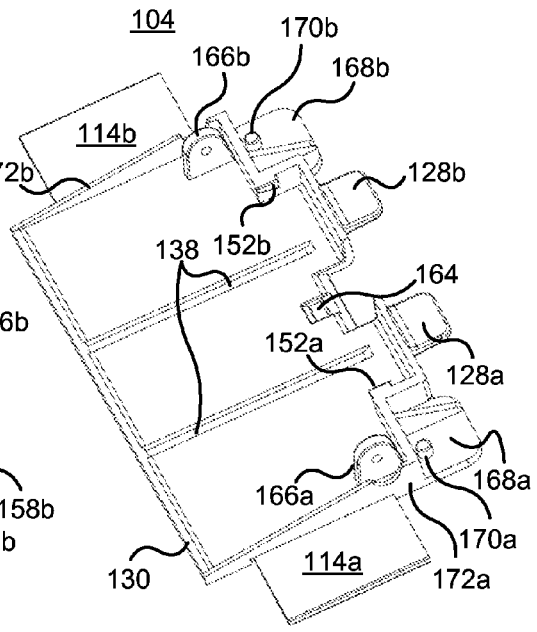
FIG. 5B is a perspective view of a second panel of the cleaning head.
Figure 6:
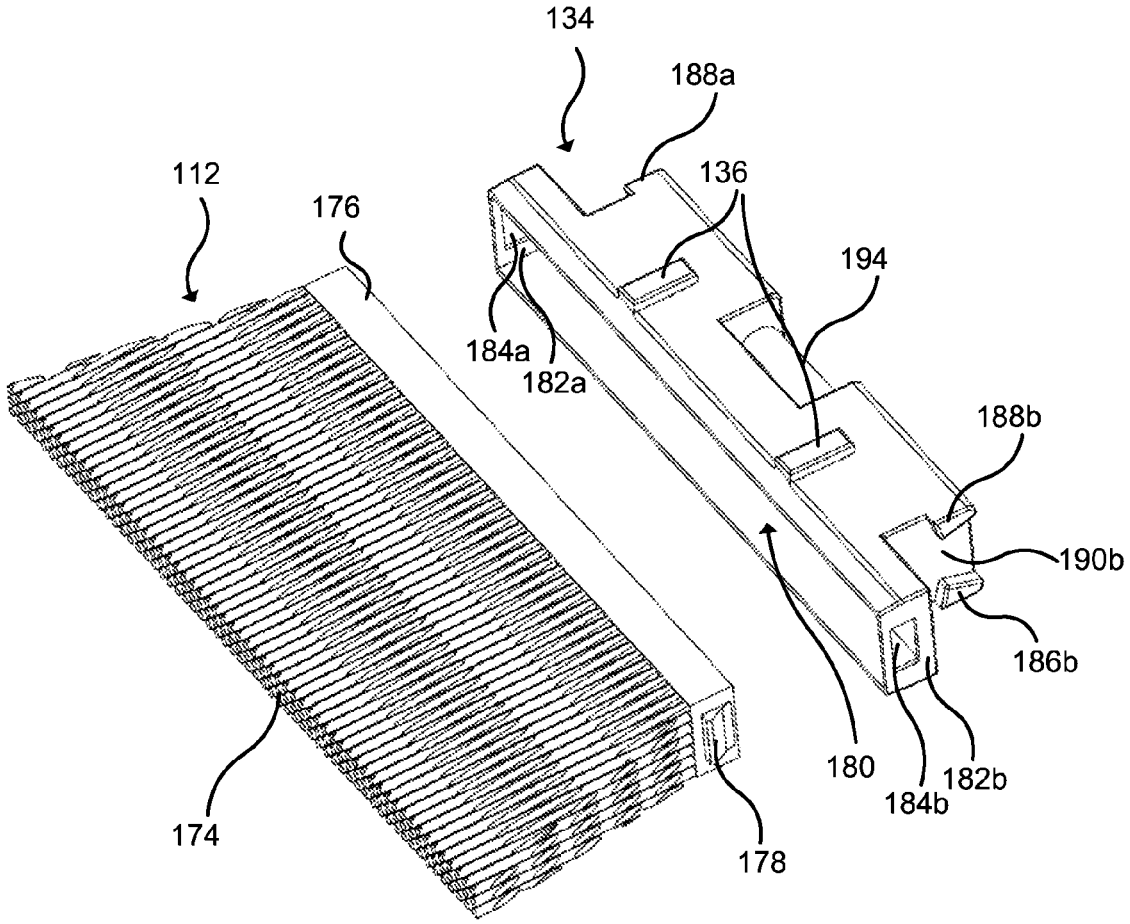
FIG. 6 is an exploded perspective view of a broom head and broom casing.
Figure 7:
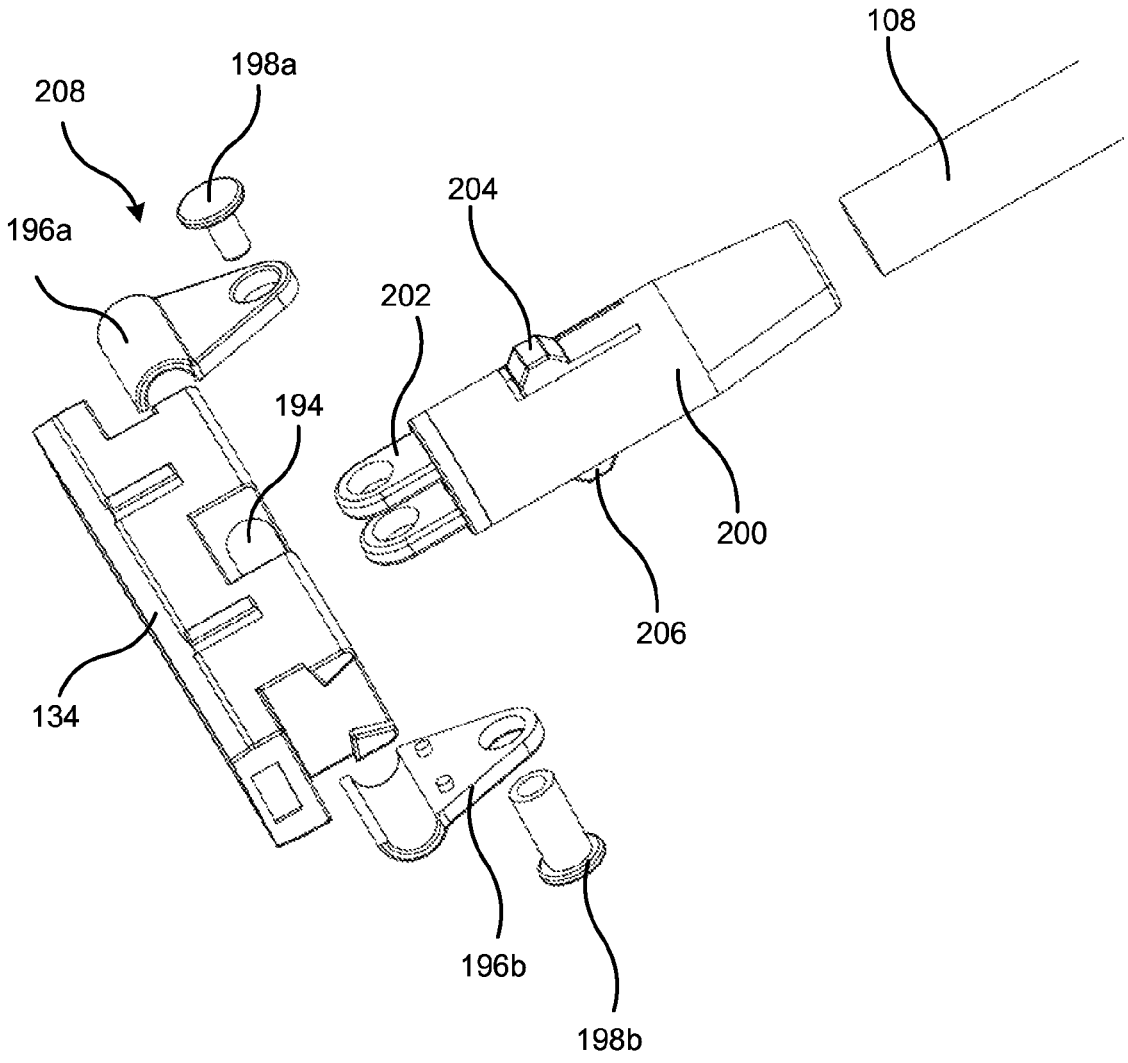
FIG. 7 is an exploded perspective view of a broom casing and handle connector.
Figure 8:
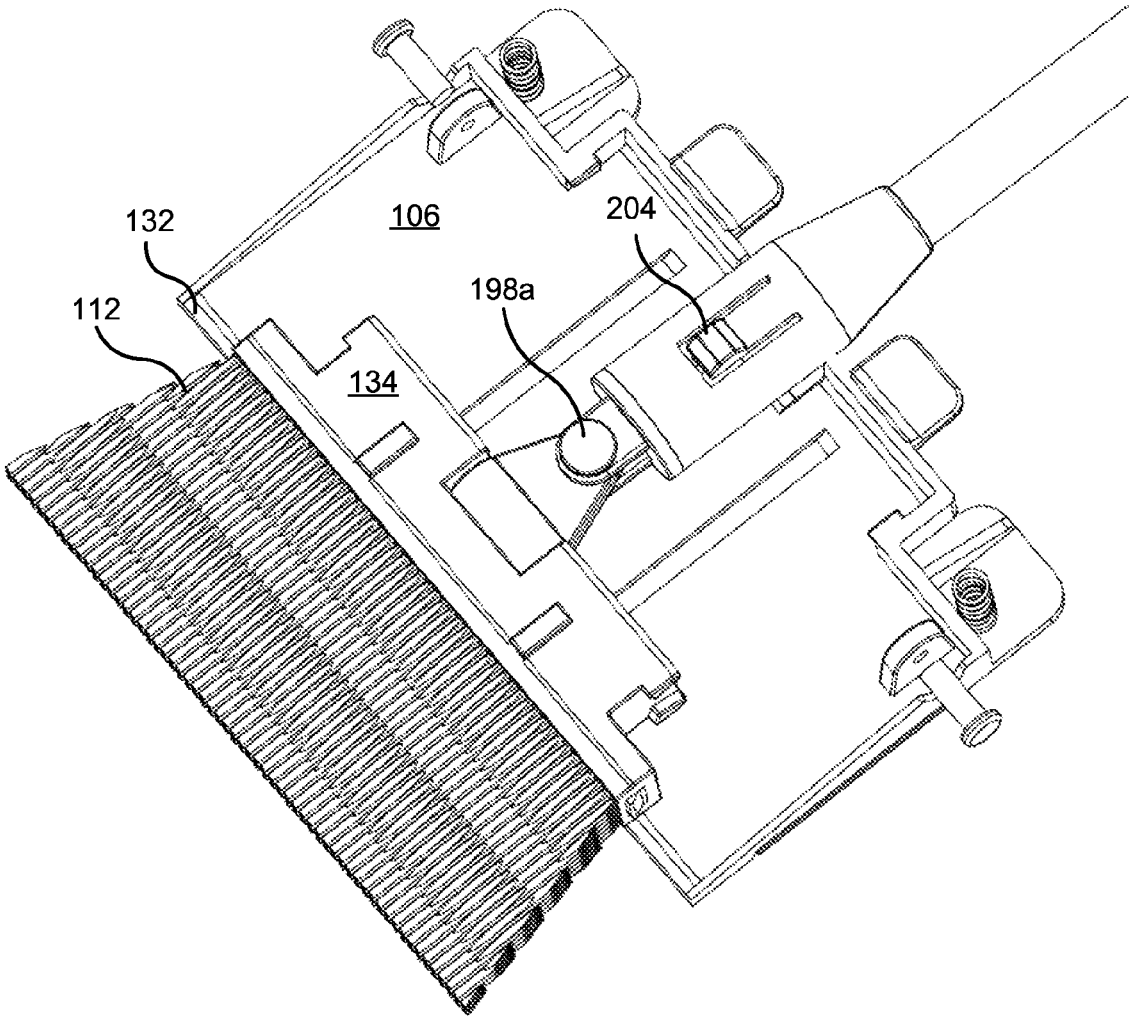
FIG. 8 is a perspective view of a partially assembled cleaning head in the first position.
Figure 9:
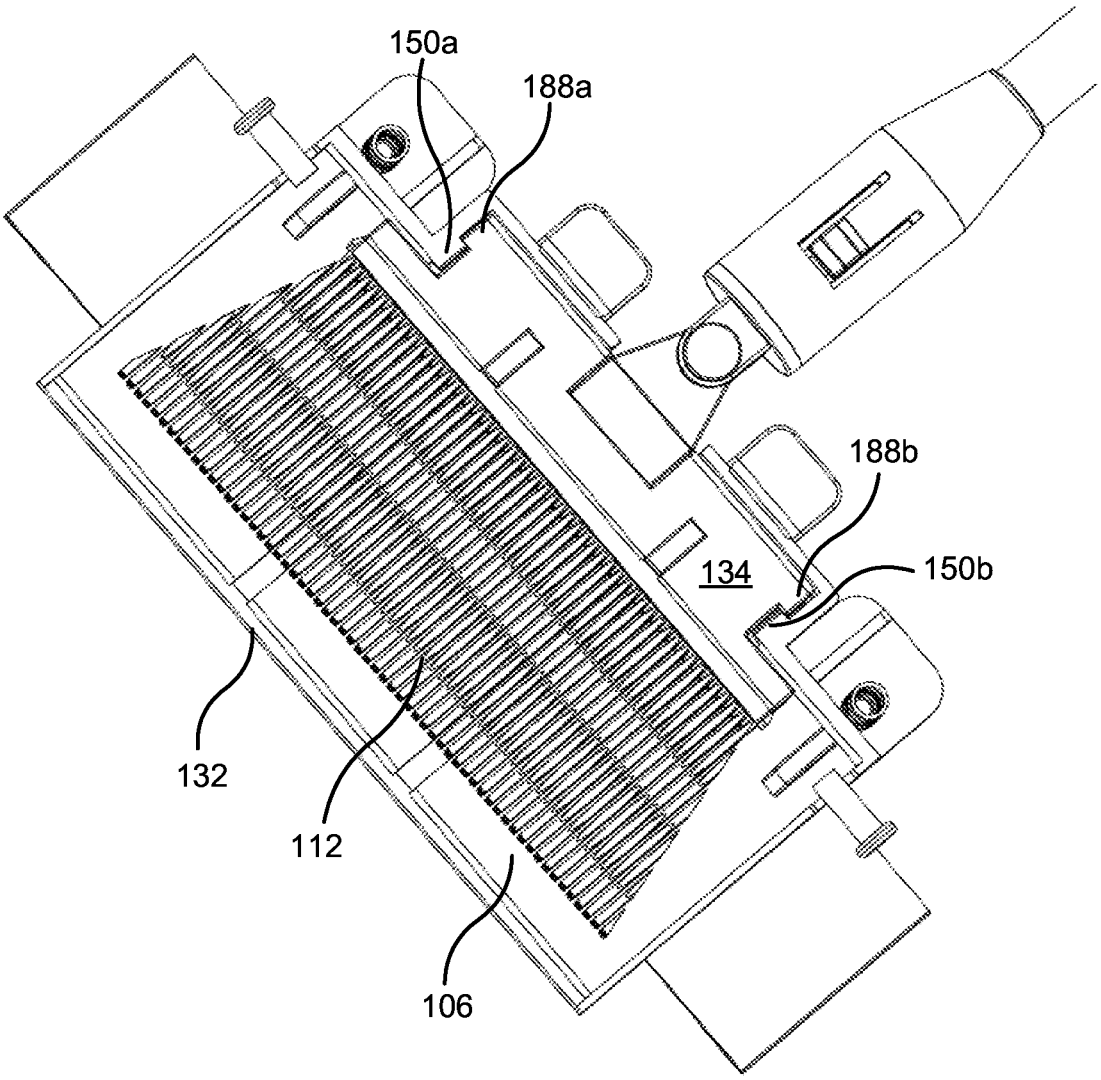
FIG. 9 is a perspective view of a partially assembled cleaning head in the second position.

Components of an illustrative embodiment of the cleaning apparatus are described in further detail with reference to FIGS. 2 to 9). As described above, the cleaning head 102 comprises a broom head 112 that is coupled between two panels 104, 106 to allow it to move between an extended position and a retracted position. The first panel 104 and the second panel 106 of the cleaning head 102 are pivotally connected together about pivot points 156*a,b* and 166*a,b* by bolt, rod, screw or similar axis 122*a,b*. The individual panels 104, 106 are depicted in FIGS. 5A and 5B. Although the first panel 104 and second panel 106 are depicted as being different, and in particular with regards to the pivot points 156*a,b* and 166*a,b*, it is contemplated that the two panels 104, 106 could be identical. The pivotally connected panels 104, 106 can be biased towards a closed position by springs 124*a,b*. When the panels 104, 106 are in the closed position, the broom head may be locked, or retained, in the retracted position.

In order to allow the cleaning head 112 to move between the retracted and extended positions, the two panels 104, 106 can be pivoted from the closed position to an open or unlocked position, which allows the broom head 112 to be slid between the extended and retracted position. The pivotal movement of the panels can be accomplished by pressing on opening/closing levers 126*a,b*, 128*a,b* on first and second panels 104, 106. The opening/closing levers 126*a,b*, 128*a,b* may be provided by a portion of the respective panels 104, 106 that extends away from the pivot point in order to provide leverage when pivoting the panels. It is contemplated that means for pivoting the panels together other than the opening/closing levers are possible, such as handles or grips on the panels. The pressing motion on the opening/closing levers 126*a,b*, 128*a,b* is resisted by the restoring force of the springs 124*a,b* coupled between the first and second panels 104, 106.

The springs 124*a,b* can be mounted between the panels at a mounting support section 158*a,b* and 168*a,b* at each corner of the first and second panels 104, 106 which provide a surface that the springs 124*a,b* can be seated on. The mounting support sections 158*a,b* 168*a,b* may extend away from the first and second panels 104, 106 and extend a contact surface of the first and second panels 104, 106 past the axis of the handle connection point 194 to the cleaning head. By extending the contact surface, that is the portion of the cleaning head 102 that is in contact with the cleaning surface when mopping and/or scrubbing, back past the axis of the handle connection point 194, rotational movement about the back edge of the cleaning head 102 without the extending mounting support sections 158*a,b* 168*a,b*, may be prevented or reduced. The mounting support sections 158*a,b* 168*a,b* may include spring mounting points 160*a,b*, 170*a,b* which are protrusions that extend into the springs 124*a,b* to maintain the alignment of the springs between the mounting support sections 158*a,b*, 168*a,b*. Alternatively, any plurality of springs can be situated at any suitable locations between the first and second panels 104, 106 such that the panels 104, 106 are biased to return to the closed position.

When the broom head 112 is in the retracted position, the panels 104, 106 can be used for mopping or scrubbing. Each of the panels 104, 106 includes an interior side, shown in FIGS. (5A and 5B), and an exterior side. The exterior side of each panel provides a cleaning surface that can be used for mopping or scrubbing, when the broom head 112 is in the retracted position. The cleaning surfaces allow a desired cleaning material to be affixed to the cleaning apparatus 100.

Although it is possible to provide a mopping or scrubbing surface that is permanently attached to the panels 104, 106, it is contemplated that a replaceable mopping or scrubbing pad, or other desired cleaning material, is preferable. To facilitate affixing cleaning materials to the respective cleaning surface of the panels 104, 106, the exterior side of the panels 104, 106 can be provided with attachment points 118, such as hook and loop fasteners, buttons, zippers, snaps, adhesive, press-in points for receiving a portion of the cleaning material. Additionally or alternatively, the cleaning material may comprise a fastening means for securing the cleaning material to the panels, such as ties, straps or pockets for receiving a portion of the panel. It is contemplated that the cleaning material can also be attached to the panel surfaces by pressing the cleaning material inside rubber grippers that are located at desired spots on the panel surfaces. As will be appreciated, different cleaning materials may be provided on the different panels. The cleaning materials may provide different functionality such as wet mopping, dry mopping or scrubbing.

The panels 104, 106 may include extendable wings 114*a,b*, 120*a,b* that allow larger sized cleaning materials to be attached to the panels. The extendable wings can be pulled out from a recess of the panels 104, 106 using for example recessed handles 116*a, b*, and may comprise attachment points 140*a,b*, 144*a,b* for attaching the cleaning materials to the extendable wings.

As described above, the broom head 112 can be moved between an extended position and a retracted position. In the retracted position, the broom head 112, or bristles 174, are retracted between the two panels 104, 106 such that a substantial portion of the bristles 174 of the broom head are retracted past bottom edges 130, 132 of the two panels 104, 106. The bristles 174 may be confined within the panels 104, 106 through the use of flexible broom guards 146*a,b*, which provide a guide surface preventing the bristles 174 from extending out the sides of the panels when retracted. The shape and form of the flexible broom guards 146*a,b* are such that the closing of the panels 104, 106 is not obstructed. It is contemplated that the broom guards 146*a,b* may also be made from non-flexible material so long as the shape of the broom guards 146*a,b* does not prevent the panels 104, 106 from pivoting together when the broom head 112 is in the second position. In the extended position, the broom head 112 is extended so that the broom head 112, or at least a substantial portion of the bristles of the broom head 112, extend past the bottom edges 130, 132 of the two panels 104, 106. The movement of the broom head 112 can be guided by a broom casing 134.

The broom head 112 can be removably attached from the broom casing 134. The attachment and detachment can be provided by cooperating components on the broom head 112 and broom casing 134. The broom head 112 may comprise a bristle frame 176 that holds bristles 174 of the broom head together. The bristles 174 extending from the bristle frame 176 can be either straight or angled as desired and may be of differing lengths and materials. The bristle frame 176 can be received within a bristle frame opening 180 in the broom casing 134. In order to secure the broom head 112 within the broom casing 134, the bristle frame 176 can be provided with broom head lock protrusions 178 on each side of the bristle frame. When the bristle frame 176 is received within the bristle frame opening 180 of the broom casing 134, the lock protrusions 178 are received within corresponding broom head lock apertures 184*a,b* located on sides 182*a,b* of the broom casing 134. The lock protrusions 178 can be pushed through the apertures 184*a,b* in order to detach the broom head from the broom casing 134.

The broom casing 134 comprises protruding slide guides 136 that are received within corresponding slide tracks 138 in the two panels 104, 106. The movement of the broom head 112 may be achieved by movement of the broom casing 134, which is guided by the protruding slide guides 136 and the slide tracks 138. When the slide guides 136 are received within the slide tracks 138, the movement of the broom head 112 is restricted to be linear. The tracks can limit the movement of the broom casing so that the broom head cannot move past the extended position and retracted position. That is, the two extremities of the sliding motion of the broom casing 134, and so the attached broom head 112, may be defined by the ends of the slide tracks 138. It is contemplated that the slide guides 136 and slide tracks 138 can be of various geometries and located at different positions such that the movement of the broom head 112 is restricted to be linear only.

The broom casing 134 can be connected to the handle 108. The broom casing 134 may be connected to the handle 108 by means of a handle connector 208 which may be coupled to a handle connection point 194 of the broom casing 134. The handle connector 208 provides two-degrees of freedom. A first component of the handle connector 208 rotatably connects to the handle connection point 194, which may be a rod or similar axis, of the broom casing 134. The first component can be provided by two pieces 196*a,b* which are secured to each other over the handle connection point 194, allowing the first component to rotate about the handle connection point 194. A second component 202 of the handle connector 208 is rotatably connected to the two pieces of the first component 196*a,b*. The first component can be connected to the second component 202 by a separable pivot connector 198*a,b* that provides a rotation axis for the second component 202. One of the pivot connectors 198*a* may have a threaded male portion, and the other pivot connector 198*b* may have a threaded female portion. The pivot connectors 198*a,b* can be placed through holes in the two pieces 196*a,b* of the first component and through holes of the second component 202. With the pivot connectors 198*a,b* secured together, the first component is rotatably connected to the handle connection point 194 of the broom casing 134 and the second component of the handle connector 202 is rotatably connected to the first component, thereby providing two-degrees of freedom for the cleaning head. The second component of the handle connector 208 is attached to a handle receiver 200 that receives the handle 108. The handle connector 208 may include extension lock protrusions 204, 206 that can lock or restrain the broom casing in the extended position, as described further below.

The two panels 104, 106 may each comprise an extension lock comprising extension lock detents 154, 164 and the cooperating extension lock protrusions 204, 206 of the handle connector 208 to lock the broom casing in the extended position. The extension lock detents 154, 164 are located so that they receive the extension lock protrusions 204, 206 when the broom casing 134 is in the extended position. The extension lock protrusions 204, 206 may be resiliently depressed so that they can be moved out of the detents 154, 164 when a sufficient force is applied. However, the force required to move the protrusions 204, 206 from the detents 154, 164 should be sufficiently high so that the broom casing 134 does not unintentionally move from the extended position while in use. With the broom casing locked in the extended position by the cooperation of the protrusions and detents, the handle 108 is prevented from rotating relative to the broom casing 134 to facilitate sweeping with the extended broom head 112. Although the broom casing 134 is described as being locked in position by the protrusions and detents, it will be appreciated that other locking mechanisms can be provided. For example, protrusions could be provided on the broom casing 134 that cooperate with detents located at an appropriate position on the panels 104, 106.

When the broom casing 134 is locked in the fully extended position, it can be disengaged by pulling the handle or otherwise retracting the broom casing with a force sufficient in order to cause the lock protrusions 204, 206 of the handle connector 208 to be depressed and exit the detents. This may be assisted by holding or pressing on the opening/closing levers 126*a,b*, 128*a,b* on the first and second panels 104, 106 and pulling out on the handle 108 to retract the broom casing 134 between the panels. This causes a sliding motion of the broom casing 134, guided by the protruding slide guides 136 in the slide tracks 138, from the extended position to the retracted position. With the broom casing 134 in the retracted position, the opening/closing levers 126*a,b*, 128*a,b* on first and second panels 104, 106 can be released and the restoring force of the springs 124*a,b* return the panels to the closed position. With the broom casing 134 in the retracted position, and the panels 104, 106 returned to the closed position, a further locking mechanism is engaged to prevent the broom casing 134 from moving out of the retracted position.

The locking mechanism that maintains the broom casing 134 in the retracted position comprises interacting components on the broom casing 134 and the panels 104, 106. Each side of the broom casing 134 may include a lower lock protrusion 186*a,b* and an upper lock protrusion 188*a,b*. The lower and upper protrusions define a passageway 190*a,b* between them. The panels 104, 106 include lock protrusions 150*a,b*, 152*a,b* that interact with the lower lock protrusion 186*a,b* and the upper lock protrusion 188*a,b* to prevent movement of the broom casing 134. The lock protrusions 150*a,b*, 152*a,b* can pass through the passageway 190*a,b* when the panels are pivoted together using the opening/closing levers 126*a,b*, 128*a,b*.

Figure 10A:
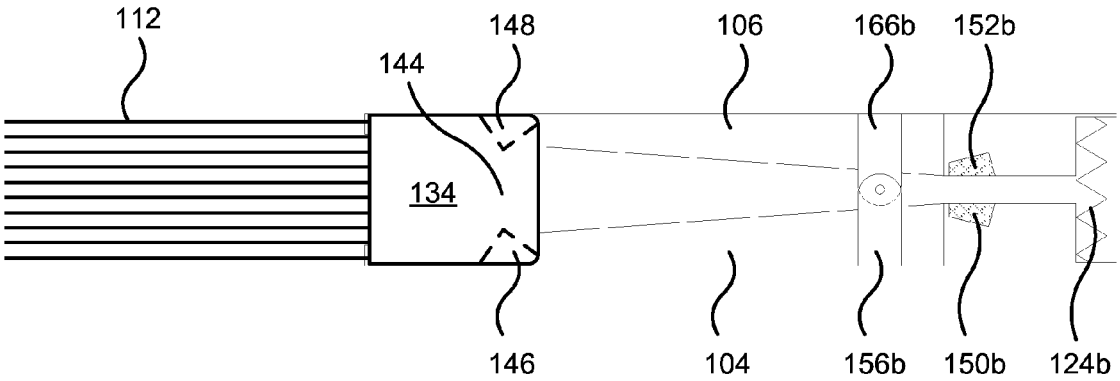
FIGS. 10A-10C are block diagrams depicting the broom casing in different positions.
Figure 10B:
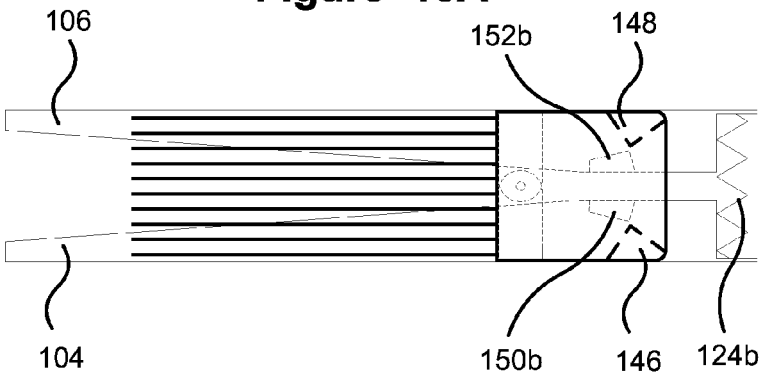
Figure 10C:
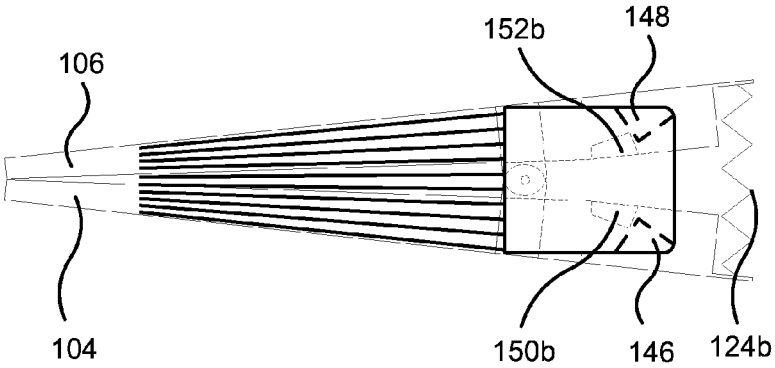

FIGS. (10A to 10C) are schematics of the operation of the locking mechanism that maintains the broom casing in the retracted position. FIG. 10A depicts the broom casing 134 in the extended position. The opening/closing levers 126*a,b*, 128*a,b* can be pressed together and the broom casing 134 slid up as depicted in FIG. 10B. With the panels 104, 106 pivoted together with the opening/closing levers 126*a,b*, 128*a,b*, the lock protrusions 150*a,b*, 152*a,b* of the panels can pass through the passageways 190*a,b*, allowing the broom casing 134 to be slid past the lock protrusions 150*a,b*, 152*a,b* to the retracted position. Once the broom casing 134 is in the retracted position, the opening/closing levers 126*a,b*, 128*a,b* can be released, which causes the panels to return to the closed position of FIG. 10C due to the biasing springs 124*a,b*. With the panels 104, 106 in the closed position, the lock protrusions 150*a,b*, 152*a,b* are moved so that they interact with the lower protrusions 186*a,b* and upper protrusions 188*a,b* of the broom casing 134 preventing movement from the retracted position.

The broom casing 134 can be extended from the retracted position by pressing the opening/closing levers 126*a,b*, 128*a,b* together to allow the lock protrusions 150*a,b*, 152*a,b* to pass through the passageways 190*a,b* of the broom casing. Once the broom casing is in the extended position, the extension locking protrusions 204, 206 can engage the extension detents 154, 164 and lock the broom casing 134 in the extended position until a sufficient force is applied to move the lock protrusions 204, 206 of the handle connector from the detents 154, 164.

Figure 11B:
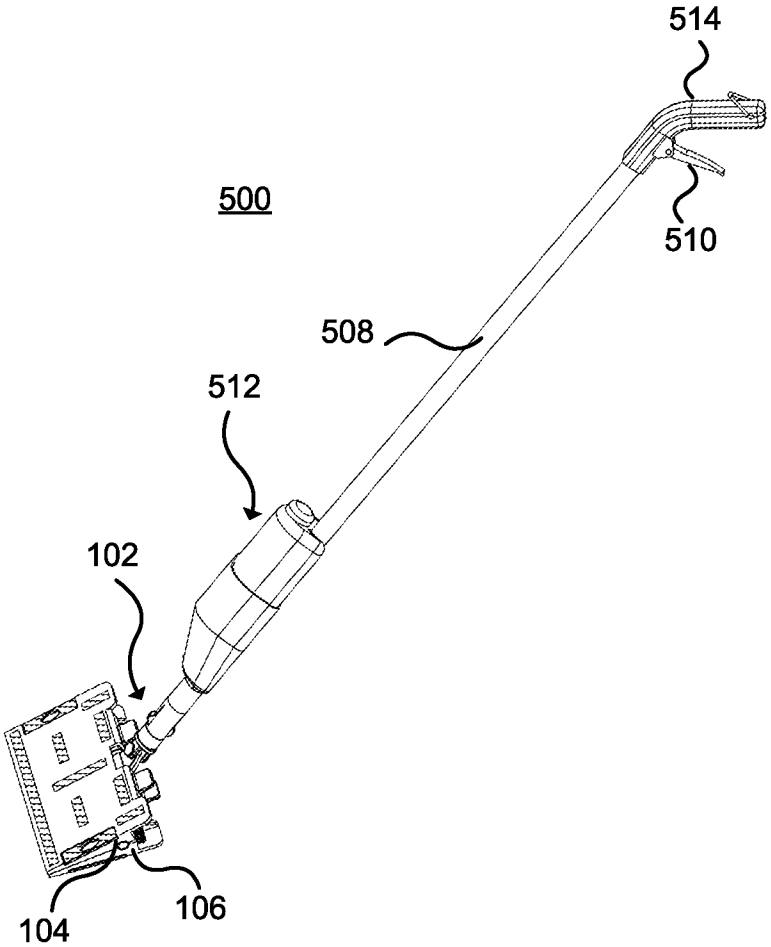
FIG. 11B is a perspective view of the multipurpose cleaning apparatus of FIG. 11A in a second position.
Figure 11A:
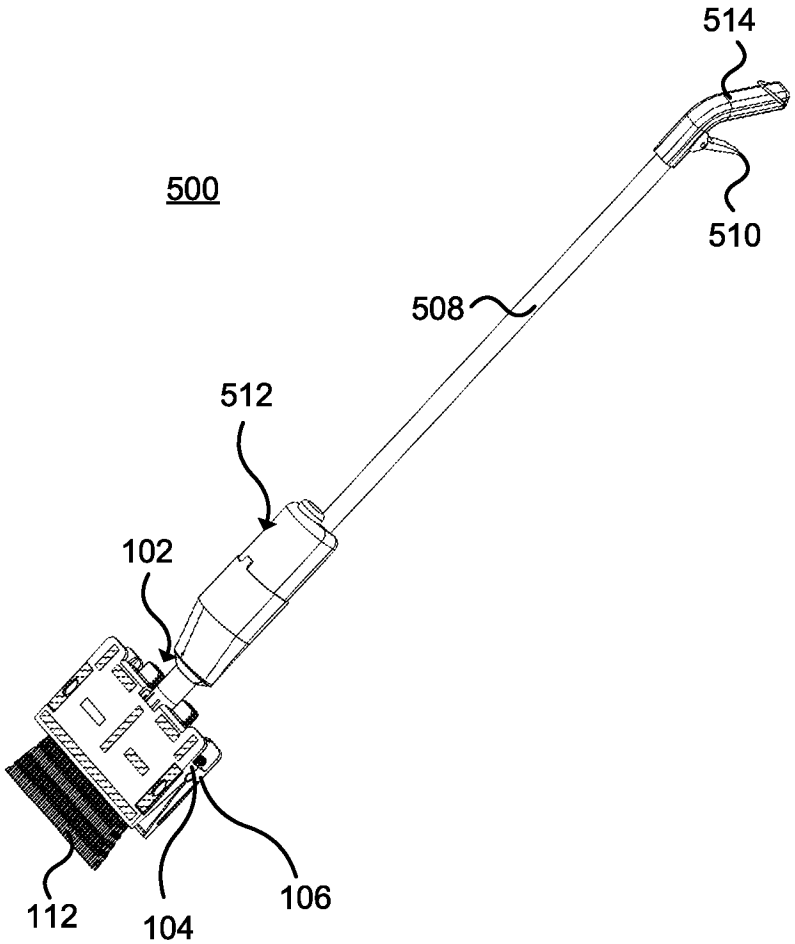
FIG. 11A is a perspective view of a further embodiment of a multipurpose cleaning apparatus in a first position.

FIGS. 11A and 11B depict a further embodiment of a cleaning apparatus. The cleaning apparatus 500 is similar to the cleaning apparatus 100 described above and as such only the differences will be described further herein. FIG. 11A shows the cleaning apparatus 500 in its extended position for sweeping and FIG. 11B shows the cleaning apparatus 500 in its retracted position for mopping/scrubbing. The cleaning apparatus 500 includes the cleaning head 102 described above, which is attached to an activating rod casing 508 with a handle 514 located at an end opposite the cleaning head. A liquid dispenser 512 is attached to the activating rod casing 508 that allows a liquid to be dispensed on to a surface being cleaned. An activator 510 can control the dispensing of the liquid. The activator 510 causes an activating rod that passes through the interior of the activating rod casing 508 to move and activate the liquid dispensing. The second embodiment enables the present invention to dispense liquid over the cleaning surface in the form of water or any cleaning solution as desired and appropriate. The mechanism that allows for both the retraction and extension of the cleaning apparatus 500 functions the same as described above for cleaning apparatus 100.

In order to be able to use the liquid dispenser 512 with both of the cleaning surfaces, an additional degree of freedom is required in the handle connector 518. In particular, the handle connector provides 360 degrees of rotation about the axis of the activating rod casing 508, so that the liquid dispenser 512 can be oriented in the appropriate direction for dispensing the liquid when either cleaning surface is being used.

Figure 12:
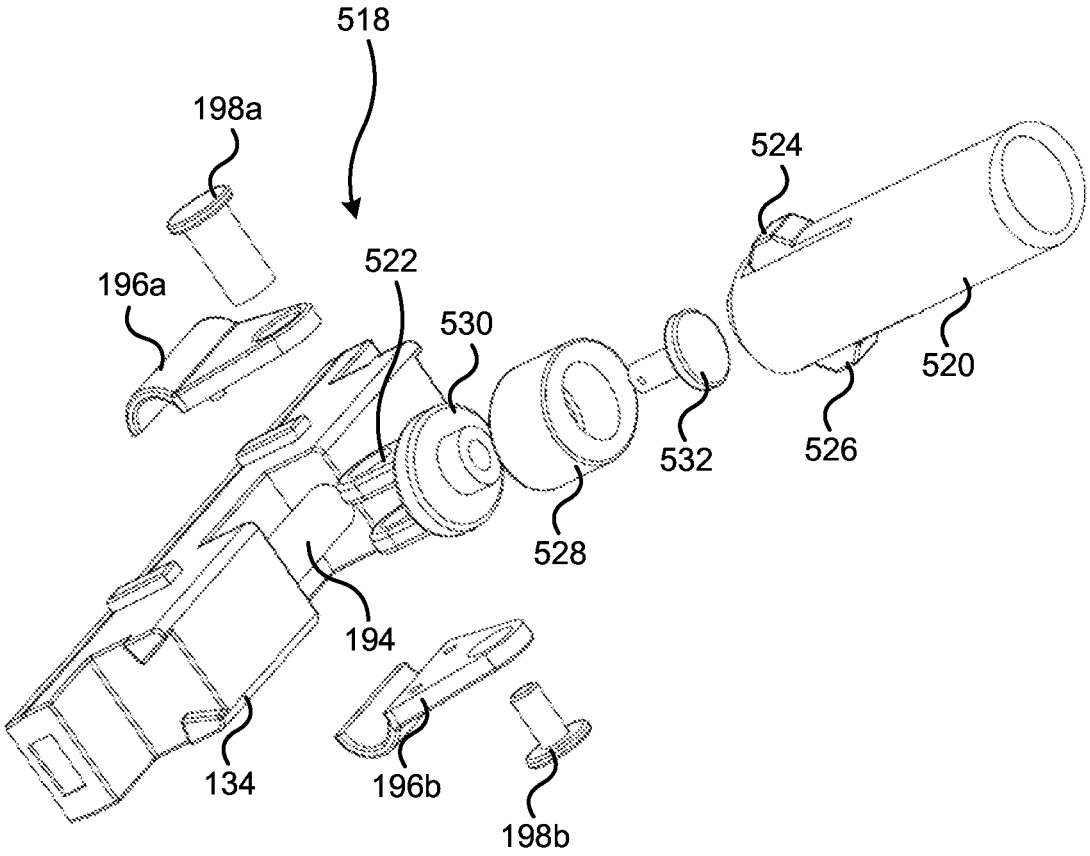
FIG. 12 is an exploded perspective view of the broom casing and further handle connector.

A handle connector 518 for use with the liquid dispensing embodiment of the cleaning apparatus 500 is depicted in FIG. 12. FIG. 12 depicts an exploded view of the handle connector 518. The handle connector 518 comprises the first component of the handle connector 196*a,b* described above, rotatable about the handle connection point 194 and connected by means of a pivot connector 198*a,b* to the second rotatable component 522. The second rotatable component is connected to a third rotatable component 528, which provides rotation about the activating rod casing 508. The handle receiver 520 can be connected to the third rotatable component 528 by means of a securing nut 530 and securing bolt 532. In this case, the extension lock protrusions 524, 526 are desirable to be mirror images and likewise with the extension locking detents 154, 164 on first and second panels 104, 106. This allows for the lock to engage even if the detents and the protrusions are interchanged by rotating 180 degrees about the axis of the activating rod casing 508. Rotation about the axis of the activating rod casing 508 is enabled by rotation of the third rotatable component 528 relative to the second rotatable component 522.

Figure 13:
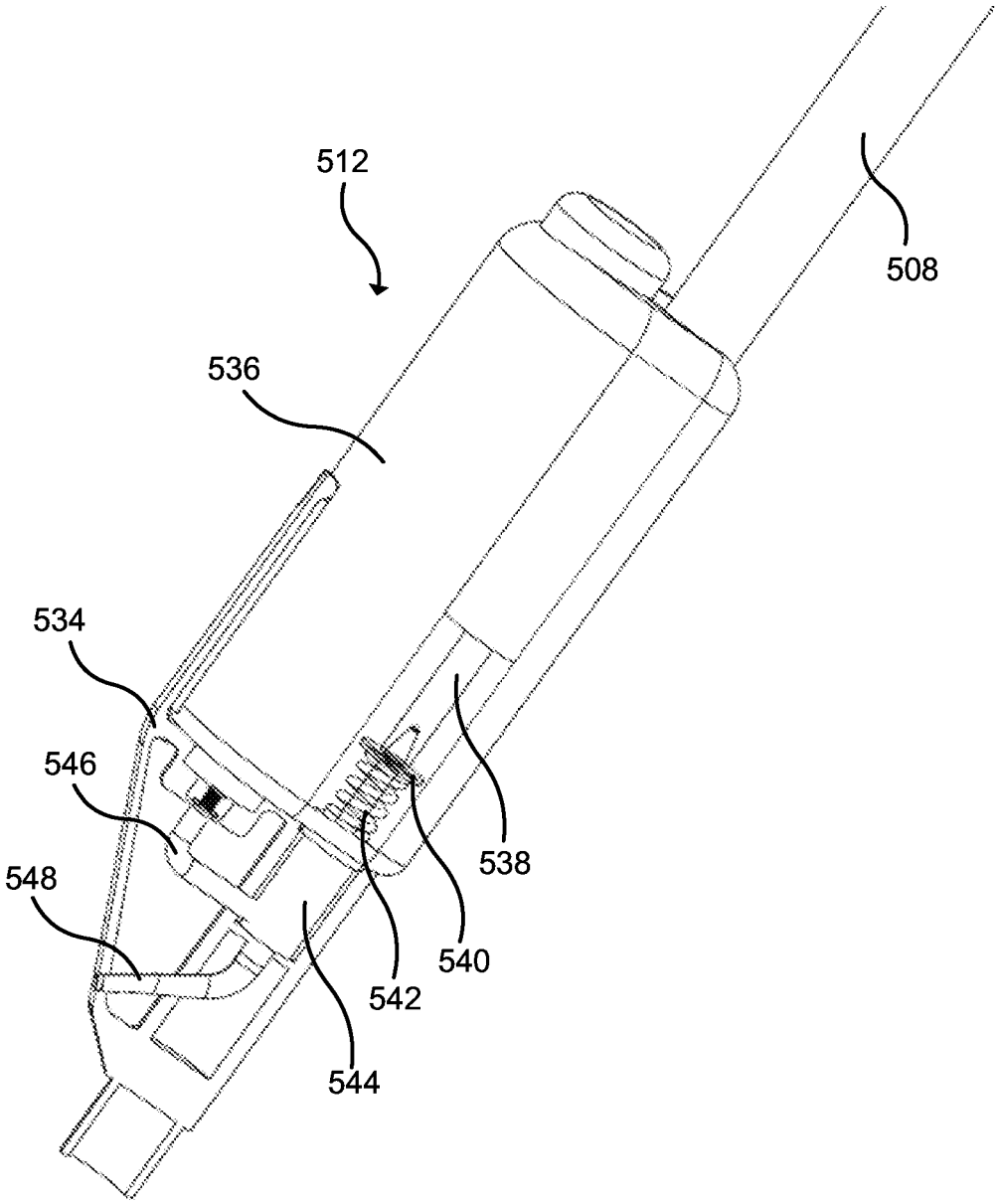
FIG. 13 is a perspective view of a solution dispenser.

FIG. 13 depicts an embodiment of the liquid dispenser. The liquid dispenser 512 is depicted apart from the cleaning apparatus 500. A liquid dispenser 512 can include a dispenser frame 534, a liquid bottle 536, an activating rod 538 which passes through the interior of the activating rod casing 508 to the activator, a plunger 540, a spring 524, a pump 544, a fluid transfer pipe 546 and a fluid nozzle 548. The liquid bottle 536 is removably mounted to the dispenser frame 534 so that it can be filled with the desired cleaning fluid. Fluid is dispensed by pulling on the activator 510 that causes the activating rod 538 to press against the plunger 540 initiating a pump mechanism to dispense the fluid on to the cleaning surface. The fluid dispensed is drawn into the pump 544 from the liquid bottle 536 during the release stroke of the activator 510. Alternatively, any other forms of spray mechanisms can also be incorporated to the present invention as desired and appropriate.

Various cleaning apparatuses have been described above by way of examples. It will be appreciated that various modifications can be made to the specific embodiments described herein.

What is claimed is:

1. A cleaning apparatus comprising:

a cleaning head comprising:

a first panel having a first cleaning surface, a first interior side opposite the first cleaning surface and a first bottom edge;

a second panel having a second cleaning surface, a second interior side opposite the second cleaning surface and a second bottom edge, the first and second panels pivotally connected to each other so that the first and second interior sides face each other with the first and second bottom edges adjacent to each other; and a broom casing received between the first and second panels, the broom casing slidable between a first position in which the broom casing is proximate to the first and second bottom edges and a second position in which the broom casing is retracted from the first and second bottom edges;

a broom head attached to the broom casing of the cleaning head, wherein a substantial portion of the broom head extends past the first and second bottom edges to allow sweeping of a surface when the broom casing is in the first position and wherein the broom head is substantially retracted between the first and second panels to allow cleaning of the surface using the first cleaning surface or the second cleaning surface when the broom casing is in the second position; and a handle rod rotatably coupled to the cleaning head.

2. The cleaning apparatus of claim 1, further comprising:

at least one locking mechanism comprising cooperating components coupled to the broom casing and at least one of the first and second panels to releasably lock the broom casing in the first and second positions.

3. The cleaning apparatus of claim 2, wherein the at least one locking mechanism comprises:

a first locking mechanism comprising first locking components on a handle connector coupled to the broom casing and at least one of the first and second panels, the first locking components interacting to releasably lock the broom casing in the first position.

4. The cleaning apparatus of claim 3, wherein the at least one locking mechanism further comprises:

a second locking mechanism comprising second locking components on the broom casing and at least one of the first and second panels, the second locking components interacting to releasably lock the broom casing in the second position.

5. The cleaning apparatus of claim 1, wherein the handle rod is rotatable about a plurality of perpendicular rotation axes, and wherein rotation about one or more of the plurality of rotation axes is prevented when the broom casing is in the first position.

6. The cleaning apparatus of claim 1, wherein the broom casing is slidable in a sliding direction perpendicular to a pivot axis between the first and second panels.

7. The cleaning apparatus of claim 6, further comprising:

protruding slide guides on the broom casing; and slide tracks located on the interior sides of at least one of the first and second panels, the slide tracks receiving the protruding slide guides of the broom casing to guide the sliding of the broom casing between the first and second positions in the sliding direction.

8. The cleaning apparatus of claim 1, wherein the first and second panels are pivotally connected to each other about a pivot axis parallel to the first and second bottom edges.

9. The cleaning apparatus of claim 1, wherein the broom head is releasably attached to the broom casing.

10. The cleaning apparatus of claim 1, further comprising a biasing component for biasing the first and second panels to a closed position.

11. The cleaning apparatus of claim 10, wherein the biasing component comprises a spring coupled between the first and second panels and opposite the first and second bottom edge from a pivot axis between the first and second panels.

12. The cleaning apparatus of claim 11, wherein the biasing component further comprises a mounting support section on each of the first and second panels extending away from the first and second panels, wherein the spring is coupled between the first and second panels by the mounting support sections, and wherein the mounting support sections extend a respective contact surface of the first and second panels beyond a connection point between the handle rod and the cleaning head, thereby reducing a rotational motion of the cleaning head on the surface when in the second position.

13. The cleaning apparatus of claim 1, further comprising a handle connector for rotatably coupling the handle rod to the cleaning head, the handle connector comprising:

a first component rotatably connected to the broom casing along a first rotation axis; and a second component rotatably connected to the first component along a second rotation axis perpendicular to the first rotation axis, the second component further coupled to the handle rod.

14. The cleaning apparatus of claim 13, further comprising:

a set of protrusions on a first side of the broom casing, the set of protrusions defining a passageway there between; and a respective protrusion extending from a corresponding first side of each panel, wherein the first and second panels are pivotable between:

an open position in which the respective protrusion of each of the first and second panels can pass through the passageway defined between the protrusions of the broom casing, allowing the broom casing to slide between the first position and the second position; and a closed position in which the protrusion on each panel interfere with the protrusions of the broom casing, preventing the broom casing from sliding from the second position to the first position.

15. The cleaning apparatus of claim 14, further comprising:

a second set of protrusions on a second side of the broom casing, the second set of protrusions defining a second passageway there between; and a respective second protrusion extending from a corresponding second side of each panel, wherein the respective second protrusions of the first and second panels can pass through the second passageway when the first and second panels are in the open position and wherein the respective second protrusions on each panel can interfere with the second set of protrusions of the broom casing when the first and second panels are in the closed position.

16. The cleaning apparatus of claim 14, further comprising:

a resiliently depressible protrusion extending from the second component of the handle connector; and a detent on the interior side of one of the first or second panel sized to receive the resiliently depressible protrusion when the broom casing is in the first position, the resiliently depressible protrusion preventing the broom casing from sliding from the first position to the second position unless a force sufficient to depress the resiliently depressible protrusion is applied.

17. The cleaning apparatus of claim 16, further comprising:

a second resiliently depressible protrusion extending from the second component of the handle connector; and a second detent on the interior side of the other one of the first or second panel sized to receive the second resiliently depressible protrusion.

18. The cleaning apparatus of claim 13, wherein the handle connector is captured between the first and second panels when the broom casing is in the first position to prevent rotation of the handle rod about the first rotation axis and the second rotation axis.

19. The cleaning apparatus of claim 1, further comprising at least one retractable extension extending from a side of one of the first or second panels perpendicular to the first or second bottom edges.

20. The cleaning apparatus of claim 1, further comprising attachment points on the first and second cleaning surfaces for securing cleaning material to the cleaning apparatus.

21. The cleaning apparatus of claim 1, further comprising a liquid dispenser mounted on the handle rod for dispensing a solution onto the surface.

22. The cleaning apparatus of claim 21, further comprising a handle connector for coupling the handle to the broom casing and providing three degrees of freedom.

* * * * *